United States Patent [19]

Vale

[11] Patent Number: 4,881,390

[45] Date of Patent: Nov. 21, 1989

[54] COMBINATION LOCK

[76] Inventor: Michael Vale, 3 Beech Avenue, Beech Barn, Sanderstead, Surrey CR2 ONN, England

[21] Appl. No.: 213,386

[22] Filed: Jun. 30, 1988

[30] Foreign Application Priority Data

Jul. 2, 1987 [GB] United Kingdom ..... 8715607
Mar. 7, 1988 [GB] United Kingdom ..... 8805377

[51] Int. Cl.[4] ..... E05B 37/02

[52] U.S. Cl. ..... 70/219; 70/213; 70/306

[58] Field of Search ..... 70/219, 213, 218, 220, 70/304, 306, 312

[56] References Cited

U.S. PATENT DOCUMENTS 1,816,575 7/1931 Full ..... 70/219
1,913,697 6/1933 Wolcott ..... 70/219
2,276,733 3/1942 Mayewski ..... 70/219

FOREIGN PATENT DOCUMENTS 2091797 8/1982 United Kingdom .

*Primary Examiner*—Robert L. Wolfe
*Attorney, Agent, or Firm*—Panitch, Schwarze, Jacobs & Nadel

[57] ABSTRACT

A door handle is mounted on a door by bolts, the handle incorporates a combination lock comprising a shaft, a plurality of discs mounted coaxially on the shaft for individual rotation thereon, each disc having a first internal annual surface formed with a depression.

The depression of at least one disc defining an abutment edge, a latch member mounted between the shaft and the annular surface and extending parallel to the shaft biasing means urging the latch member into engagement with the first annular surface, the discs being rotatable on the shaft without turning the shaft, except when all the depressions are aligned with the latch member, so that the latch member in its latched position extending into the depressions rotating in one direction of the disc or discs having an abutment surface causes the abutment surface to engage the latch member and turn the shaft. (FIG. 3)

17 Claims, 8 Drawing Sheets

COMBINATION LOCK

FIELD OF THE INVENTION

This invention relates to combination locks.

BACKGROUND OF THE INVENTION

Many people leaving their house forget to take their keys with them or cannot find their keys when they return and wish to enter the house. A combination lock for the door of the house would overcome this problem.

SUMMARY OF THE INVENTION

In one aspect the present invention provides a door handle incorporating a combination lock in the form of a plurality of discs built into the handle so that the handle will normally rotate substantially freely and not undo the door latch unless the discs are positioned in a particular combination of relative positions when turning of the handle will unlock the door latch.

In a preferred form the invention provides a combination lock comprising a shaft, a plurality of discs mounted coaxially on the shaft for individual rotation thereon, each disc having a first internal annular surface formed with a depression, the depression of at least one disc defining an abutment edge, a latch member mounted between the shaft and the annular surfaces and extending parallel to the shaft, biasing means urging the latch member into engagement with the first annular surfaces, the discs being rotatable on the shaft without turning the shaft, except when all the depressions are aligned with the latch member, so that with the latch member in its latched position extending into the depressions rotating in one direction of the disc or discs having an abutment surface causes the abutment surface or surfaces to engage the latch member and turn the shaft.

Preferably the latch member is substantially rigid and is mounted on the shaft for rotation about a second axis parallel to but spaced from the shaft axis, such that rotation of the latch member about the second axis in opposite directions moves the free end of the latch member radially inwardly and outwardly, said biasing means tending to move it radially outwardly.

In another aspect the invention provides a combination lock, not necessarily in a door handle, incorporating this type of latch member.

At least one edge of each depression is of ramp form so that rotation of one or more of the discs in the other direction causes the latch member to ride up the sides of the depressions back to its unlatched position.

Preferably indexing means is provided to provide some resistance to the turning of each disc, which resistance is less than the resistance of the shaft to turning out sufficient to hold each disc in position while the other discs are turned.

In one form each disc has a second internal annular surface formed with teeth and/or depressions and the indexing means, for example spring loaded pins mounted on the shaft, engaged the second surfaces.

In a further modification a sleeve for each disc is provided, the sleeve having a lug which engages an axial slot formed in a tubular cylinder co-axial with the shaft. An aperture is conveniently provided in the periphery of each sleeve to uncover a code carried by each disc.

Each disc conveniently is provided with a rotatable ring portion, carrying the teeth and/or depressions of the indexing means, which ring has a leaf spring allowing the ring to be rotated against the friction of the spring.

In an alternative construction the spring loaded pins of the indexing means are replaced by spring loaded ball bearings.

In another arrangement of the combination lock each disc has a rotatable ring portion, with a leaf spring allowing the ring to be rotated against the friction of the spring, the latch member having a nose portion extending into and engaging a depression of a series of depressions formed in the rotatable ring portion to prevent rotation of the ring portion when the lock is in the open position.

Preferably, the nose portion of the latch member can be displaced from its depression by a radially movable device.

Conveniently, the radially movable device is a grubscrew.

In an alternative arrangement the radially movable device is a spring-loaded pin.

The radially movable device may take the form of a knurled-headed screw threaded in the flange of a door handle incorporating the combination lock.

BRIEF DESCRIPTION OF THE DRAWINGS

Embodiments of combination lock in accordance with the invention will now be described, by way of example only, with reference to the accompanying drawings of which.

DESCRIPTION OF PREFERRED EMBODIMENTS

Figure 1:
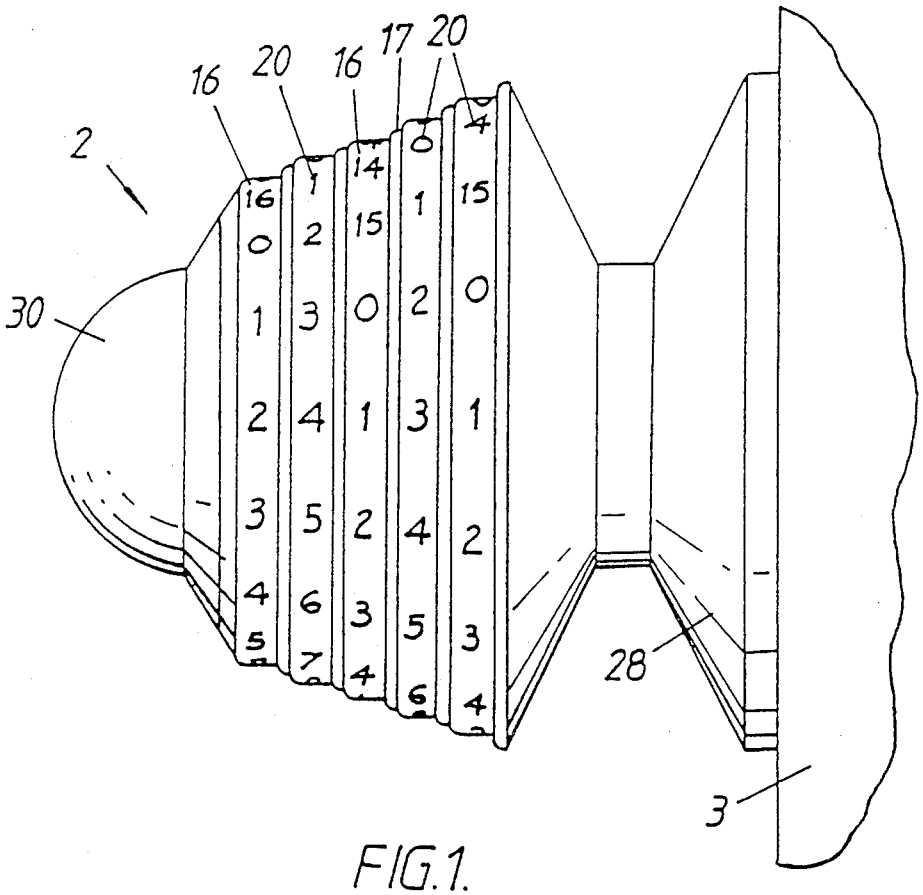
FIG. 1 is a side view of a door handle incorporating a combination lock.

A door handle 2 is mounted on a door 3 by bolts 4 and a shaft 5 which extends into the door and is operatively connected, via a square sectioned portion 6 thereof, to a door latch or bolt 7 in known manner. In the locked position the bolt 7 extends into the door frame 8.

A tubular cylinder 10 of metal or plastics material is located on the shaft 5 and secured thereto by a pin 11 preventing axial movement of the shaft relative to the cylinder. The handle incorporates five similar side-by-side discs 16 mounted on the cylinder 10 and normally substantially freely rotatable thereon in both directions. However, in one particular combination of relative positions of the discs, turning of the discs in one direction will serve to turn the cylinder 10 and the shaft 5 to unlock the door latch.

Each of the discs has a first external annular surface 17 which may be toothed or knurled or otherwise shaped to allow easy gripping, and a second external annular surface 18 carrying a code 20, for example, numbers as shown. The code is printed on a transparent plastic annulus 13, which is secured against rotation relative to the associated disc by a screw 14 located in one of a series of indentations 15 on the surface 18. Unscrewing of the screws 14 and adjusting the positions of the code allows the combination of the lock to be changed. Annulus 13 could be of metal engraved with the code.

Each disc has a first internal annular surface 21 which is substantially smooth and circular but formed with a depression 22, one edge of which is defined by a substantially radially extending abutment surface 23 and the other side of which merges into the circular surface 21 by means of a ramp portion 24. A second internal annular surface 25 has regularly spaced teeth 26 defining between them rounded grooves 27. The disc 16 at one end of the combination is connected to a shaped door handle piece 28 while the disc 16 at the other end of the combination is connected to a rounded handle end portion 30 via plate 31 and screws 32. Annular raised lugs 33 on the discs and portion 30 fit into annular grooves 34 in adjacent discs and part 28 and prevent an implement being inserted between these parts to reach the cylinder 10. Portion 30 is free to rotate on the shaft.

The cylinder 10 is formed throughout its length with a circular sectioned passage 35 extending parallel to the shaft 5 but displaced sidewardly therefrom, the passage 35 opening to the side of the cylinder via a slot 36, the width of which increases towards the exterior of the cylinder. A metal cylinder 37 is located for rotation about its axis in the passage 35 and has a slot 38 opening to one side in which slot is located one edge of an elongated latch member 40, which extends through the slot 36 to enage the surfaces 21 of the discs. A spring 41 located in an opening 42 of the slot 36 engages the latch member 40 and urges it into engagement with the surfaces 21. Because of the displacement of the axis of the passage 35 from the axis of the shaft, rotation of the latch member about the axis of cylinder 37 causes the latch member to effectively move radially inwardly and outwardly relative to the shaft axis. The free end of the latch member is shaped similarly to the shape of the depressions 22 having an abutment edge 43 and a ramp edge 44. It may alternatively have two ramp edges or a flat end.

Figure 5:
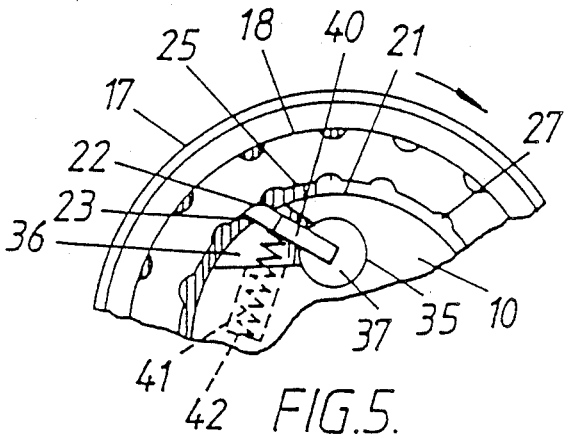
FIG. 5 shows part of the same view as FIG. 4 with the disc and latch member in a different relative position.
Figure 2:
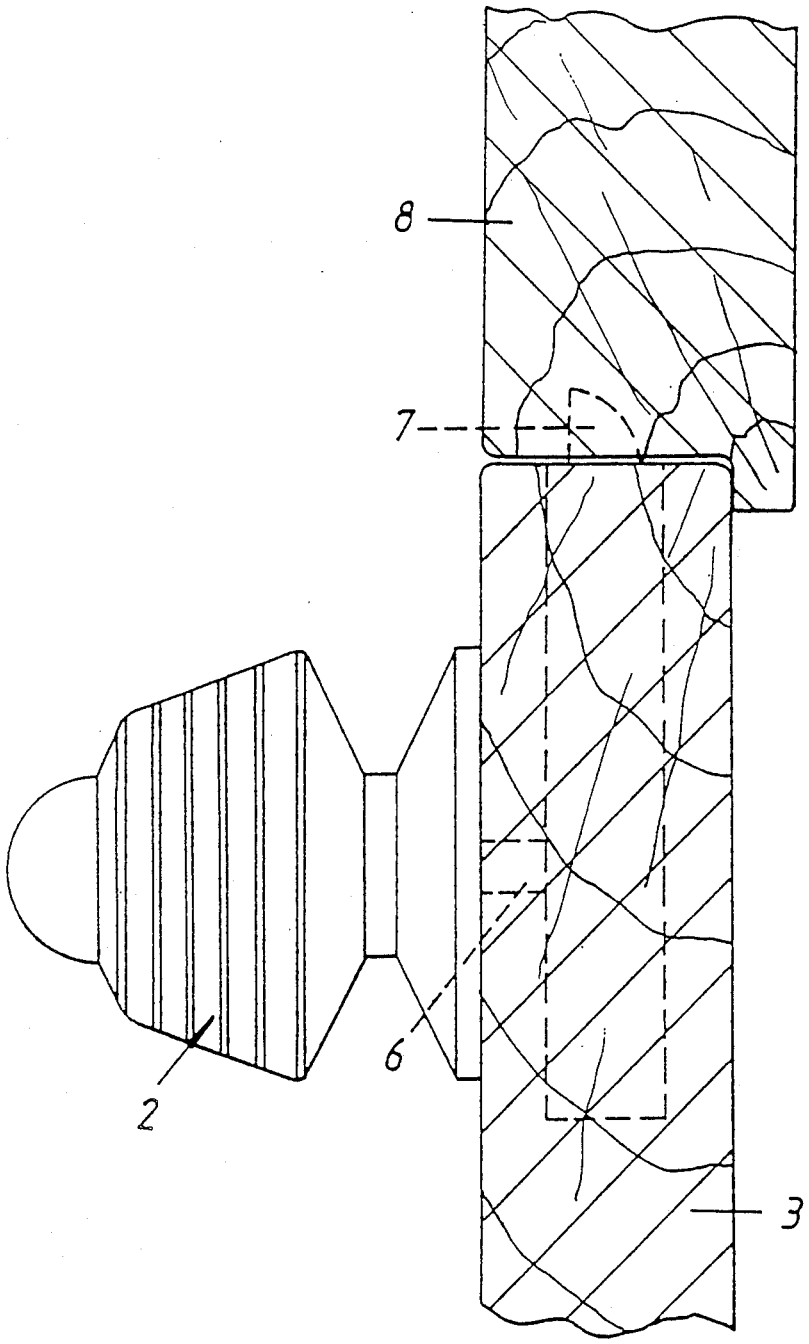
FIG. 2 is the view of the handle of FIG. 1 connected to the latch of a lock located in a door.
Figure 3:
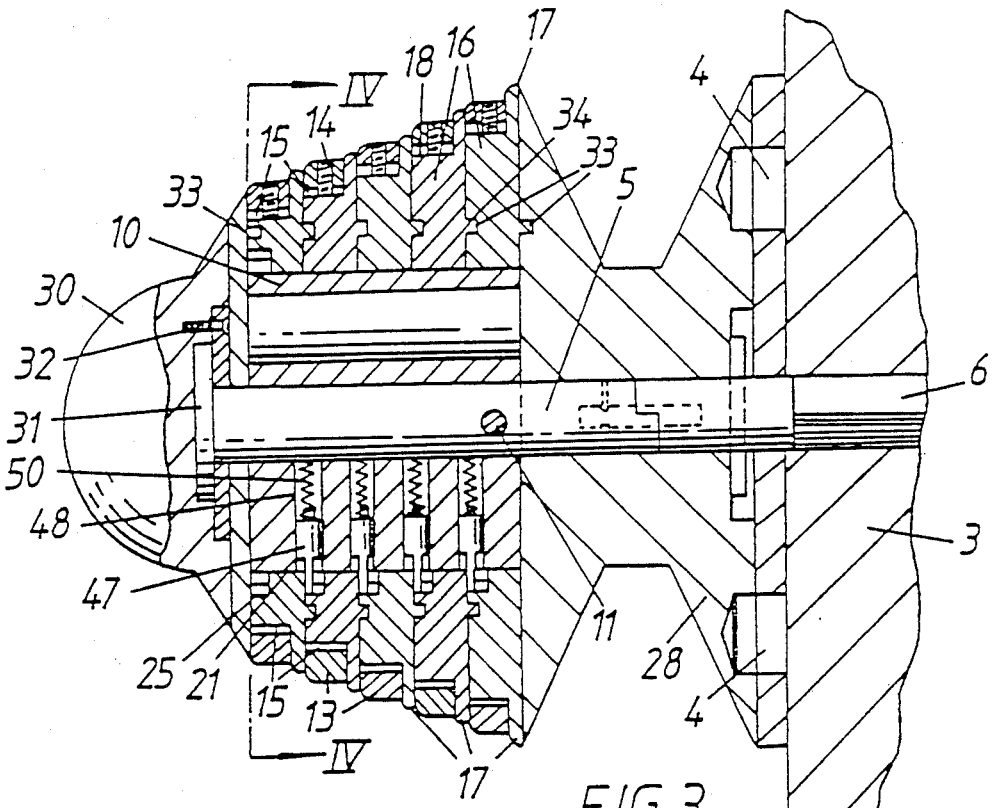
FIG. 3 is an axial section through the handle of FIG. 1.
Figure 4:
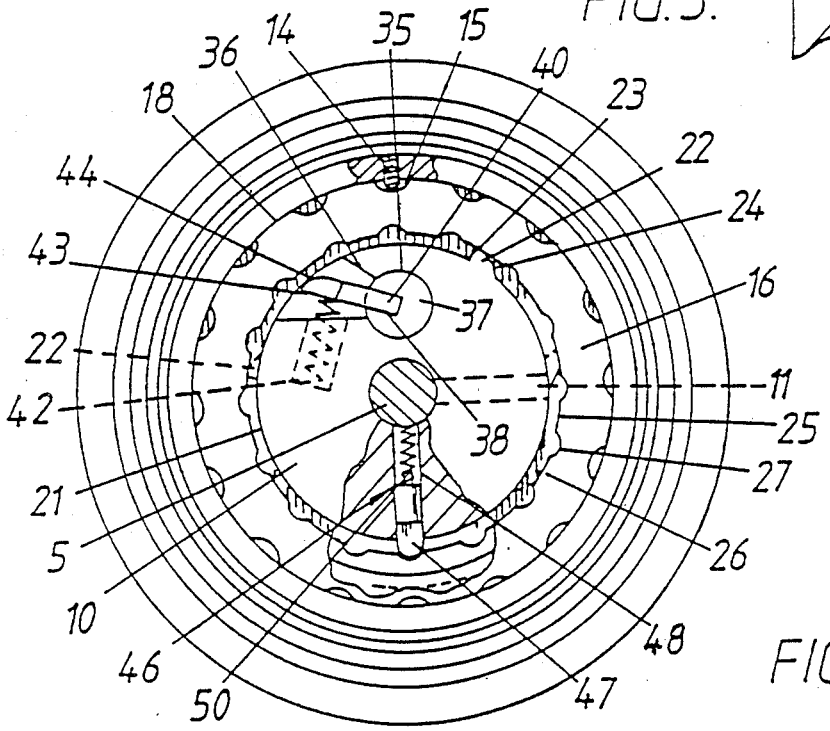
FIG. 4 is a view on the line IV—IV of FIG. 3 showing a disc and the latch member in one position.

In the unlatch position of the latch member in which the latch member engages the circular portions of surfaces 21, the discs 16 can rotate on the shaft in either direction. This remains true as long as even one circular portion 21 is engaged. However, when all the depressions 22 are aligned with the latch member, the latch member will rotate and move radially outwardly into the depressions so that the abutment surface 43 thereof engages the abutment surfaces 23 as seen in FIG. 5. Rotation of the handle, in a clockwise direction as seen in FIG. 5, now causes the turning of the shaft 5 through the engagement of the abutment surfaces. Rotation of one or all of the discs in the other direction causes the latch member to ride down the ramp or ramps 24 back to its unlatched position.

Indexing means 46 is provided to hold each disc in position while the other discs are being turned. The resistance to turning provided by the indexing means is always less than the resistance to turning of the shaft 5. The indexing means for each disc is provided by a pin 47 located in a radial passage 48 in the cylinder 10 and urged outwardly by a spring 50 into engagement with the grooves 27 in the annular surface 25. The indices of each code 20 may correspond in number to the number of grooves 27 so that each has a positively located position. The indices of the code 20 are used to select the latched position in which the depressions 22 are aligned with the latch member.

Figure 6:
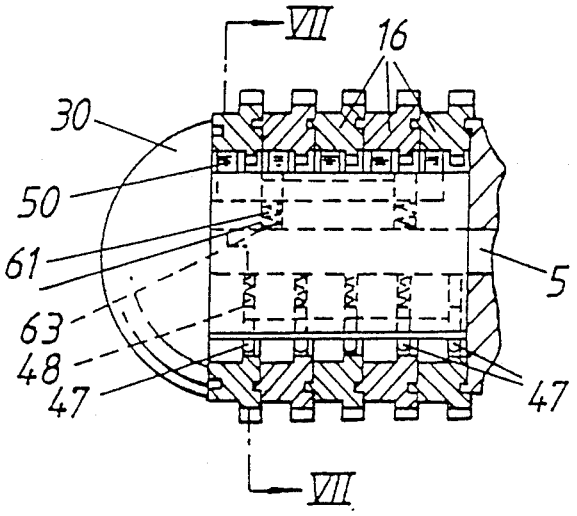
FIG. 6 is an axial section through another embodiment of door handle incorporating a lock.
Figure 7:
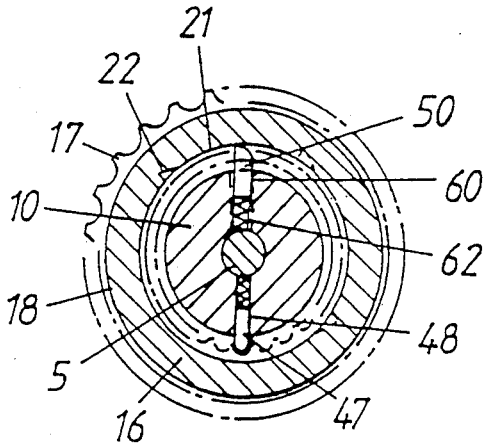
FIG. 7 is a section on the line VII—VII of FIG. 6.

FIGS. 6 and 7 show an alternative latch member which can be located in the same handle and disc system as in the embodiment of FIGS. 1 to 5. In this example the cylinder 10 is formed with a radial slot 60. A rigid latch member 50 locates in the slot 60 and has legs 61 extending into radial bores 62 which guide the latch member for radial movement while preventing rotation or tilting. The bores 62 contain springs 63 urging the latch member outwardly.

Figure 8:
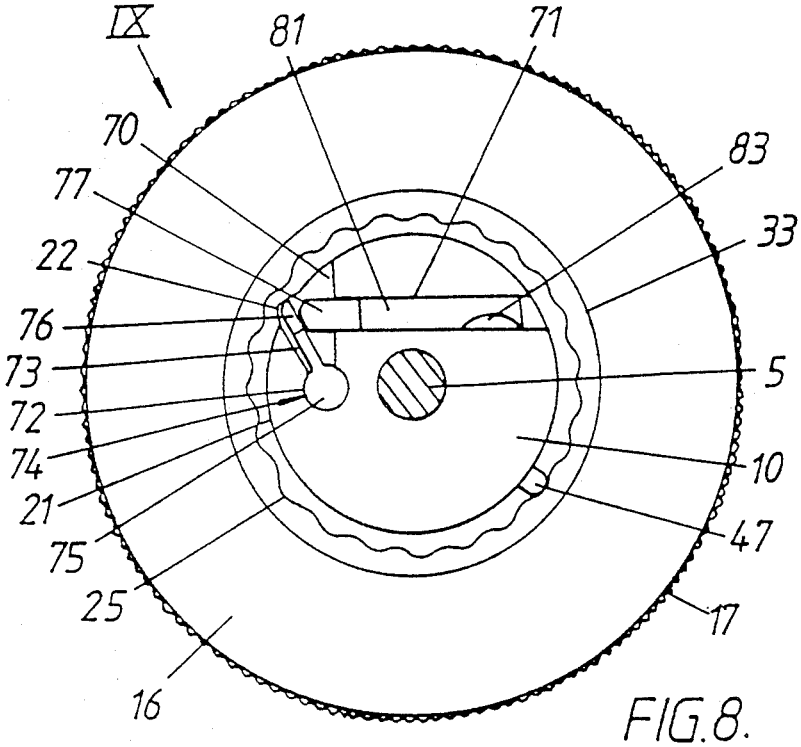
FIG. 8 is a cross-section of a modified embodiment of the door handle shown in FIGS. 1 to 5.
Figure 9:
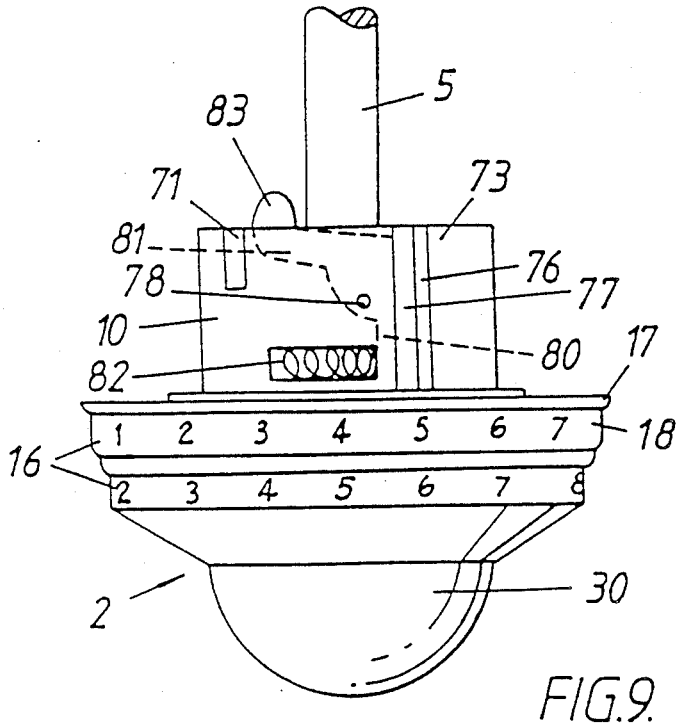
FIG. 9 is a view of the handle and discs when viewed in the direction of arrow IX of FIG. 8.

FIGS. 8 and 9 show a modified embodiment of the lock of FIGS. 1 to 5. FIG. 8 is a view of the handle and discs in a direction normal to the shaft and showing the latch member in its latched position, together with an additional catch member, and FIG. 9 is a view in the direction of arrow IX of the handle of FIG. 8 with only two discs present and the latch member in its unlatched position.

Only these features which have been modified are described, it being understood that they may be incorporated in a lock having the previously described features.

The cylinder 10 is formed with first and second slots 70, 71 extending parallel to its axis and displaced from the shaft 5. The first slot 70 has a circular sectioned portion 72 opening to a widening portion 73 extending to the edge and the second slot 71 is substantially parallel sided, opening to the widening portion 73. The latch member 74 has a circular sectioned portion 75 rotatable in the slot portion 72 and an arm 76 rotatable in the widening portion 73, the shaped end of which arm bears against the annular surfaces 21 of the discs. A catch member 77 located in the slot 71 is pivotable about a pin 78 normal to the shaft 5 and has first and second arms 80, 81. A spring 82 located in the slot 71 bears against the arm 80 and biases it against the arm 76 of the latch member, in turn acting to bias this arm outwardly towards the annular surfaces 21. The arm 81 has a projection 83, which in the unlatched position of the latch member 74 (with arm 76 bearing on the circular portion of at least one surface 21) projects beyond the rear edge of the cylinder 10 and engages in a recess (not shown) in the handle piece 28, which in this embodiment is secured to the door against relative rotation thus positively preventing turning of the cylinder relative to the door.

In the latched position of the latch member 74 (with the arm 76 projecting into the depressions 22 of all the discs) catch member 77 pivots about pin 78 to a position in which projection 83 does not project beyond the cylinder 10 so that the handle can turn.

The catch member 77 ensures that frictional force between the discs and the cylinder and shaft cannot turn them in the unlatched position.

Figure 10:
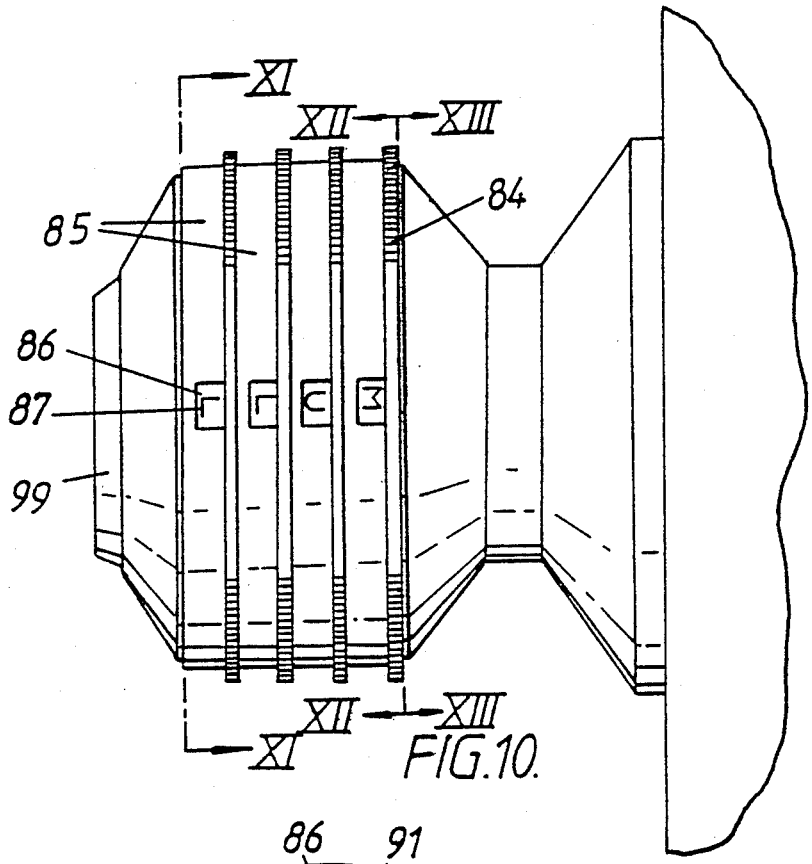
FIG. 10 is a side view of a still further embodiment of a door handle incorporating a lock.
Figure 11:
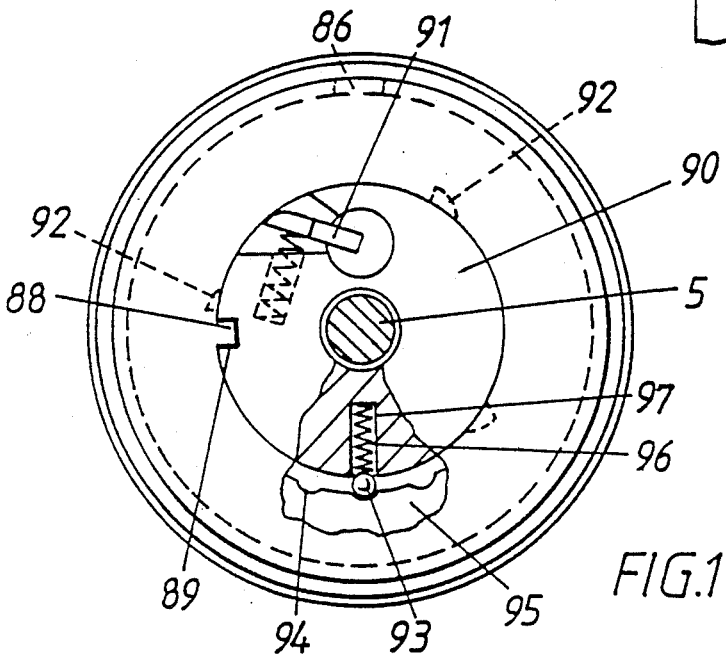
FIG. 11 is a cross-section taken along the line XI—XI of FIG. 10.

Another modified construction of the door lock, according to the invention, will now be described with reference to FIGS. 10 and 11. In this modification there are four discs 84, of corresponding outside diameters, each provided with a sleeve 85. The sleeves are each provided with an aperture to expose coded alphabetical letters 87 engraved in the periphery of each disc.

The internal periphery of each sleeve 85 has a lug 88 located in an axial slot 89 formed in the outer periphery of a cylinder 90.

In this modified construction similar parts such as the spring controlled latching member 91 which locates in the depressions 92 formed in the discs 84 operate in the same manner as in the previously described embodiments. However, the indexing plungers of the previous embodiments are replaced by ball bearings 93 which are urged into enagement with the grooves 94 formed in the annular surfaces 95 by springs 96 located in holes 97 drilled in the cylinder 90.

In operation the discs 84 are rotated so that the apertures 86 in the sleeves 85 uncover the correct alphabetical code, setting the combination, and allowing latching member 91 to engage in the depressions 92 to unlock the latching member 91 and allow the handle on shaft 5 to be rotated unlocking the lock.

In the embodiment illustrated, the rounded portion of the door handle is replaced by a flat end 99.

Figure 12:
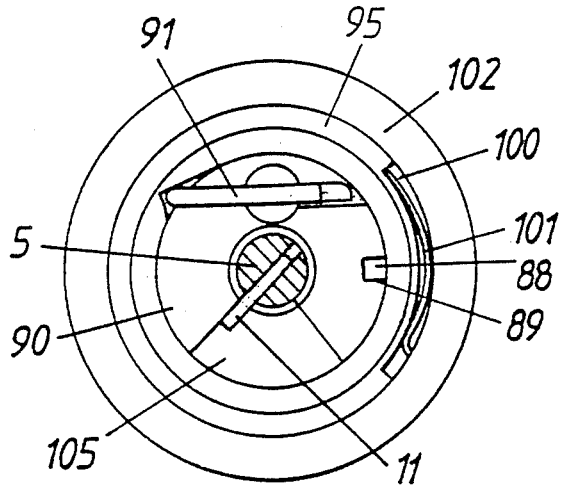
FIG. 12 is a cross-section taken along the line XII—XII of FIG. 10.

To reset the code for unlocking the lock, see FIG. 12, the outer periphery of the ring portion has an arcuate slot 100 in which is located a leaf spring 101, forming a tight frictional fit with the outer portion 102 of the disc. To reset the code, the disc or discs are positioned to set the lock in the selected open position, the knurled edges of the disc or discs are firmly gripped and rotated to override the frictional force of the leaf spring 101 moving the latching member depression of each disc relative to the cylinder 90.

Figure 13:
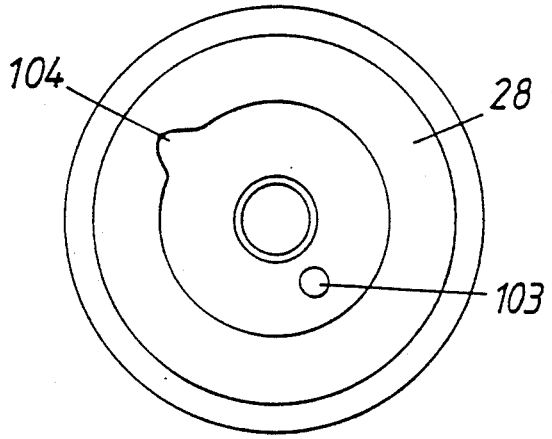
FIG. 13 is a cross-section taken along the line XIII—XIII of FIG. 10.

To enable the door handle to be opened from the inside without movement of the combination handle on the outside of the door, the handle cylinder 90 has an arcuate recess 105, see FIG. 12, which is engaged by the pin 11. Projecting from the handle base 28 as shown in FIG. 13 is a second pin 103 which strikes one side of the recess preventing the combination handle from being rotated beyond the vertical position in an anti-clockwise direction. The handle base 28 is also provided with a notch 104 which can be engaged by a transverse extension of the latching member 91 at the operating end nearest the door. If the combination handle is turned when the combination is incorrectly set, the transverse extension locks into the notch 104 preventing rotational movement of the cylinder 90.

In the above mentioned embodiment the code for resetting the lock is changed when the lock is in the locked position. This is effected by overriding the frictional forces of a leaf spring located between each disc member and the unlocking mechanism. However, this code resetting means may inadvertently be altered when the lock is in the open position with the disadvantage that a new combination may be set which is not recorded by the user resulting in the lock being set in its locked position without knowing the code unlocking combination.

Figure 14:
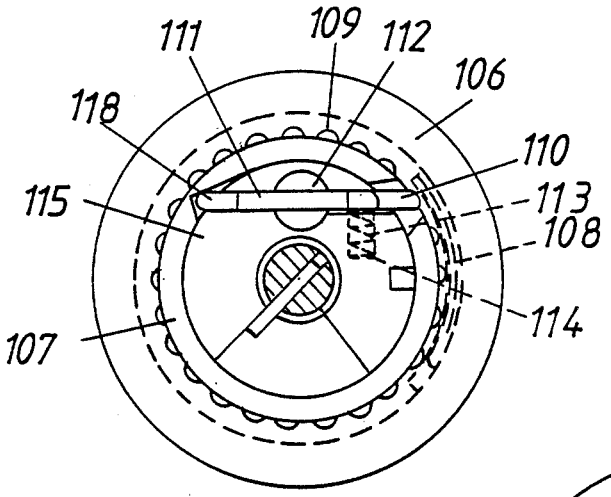
FIG. 14 is a cross-section of the improved combination lock.
Figure 15:
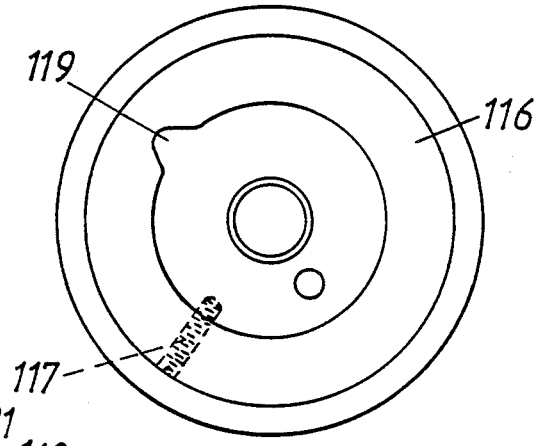
FIG. 15 is a cross-section of a flange of a door handle incorporating the combination lock.

In the improved combination lock shown in FIG. 14 and 15, the lock comprises an outer ring 106 and an inner ring 107 the two rings are held in frictional engagement by a leaf spring 108. Located around the inner circumference of the outer ring 106 are a series of depressions 109 which may be engaged by the nose portion 110 of a latch member 111. This latch member is mounted on a shaft 112 and is spring urged into engagement with the depressions 109 by a spring 113 located in an opening 114 formed in a cylinder 115 on which the combination discs are rotatably mounted.

In the open position of the lock, the latch member 111 engages one of the depressions 109 and prevents rotation of the inner ring 107 relative to the outer ring 106, thus preventing resetting of the combination code.

To release the latching member 111 a handle flange 116 (see FIG. 15) is provided with a radially movable device in the form of a grub-screw 117. By screwing the grub-screw 117 inwardly it engages the latch member 111 moving it against its spring out of engagement with the depression 109 while keeping the transverse extension 118 of the latch member in engagement with the notch 119. This enables the combination to be altered by turning the outer ring 106. When the code had been changed, the grub-screw 117 is unscrewed and the latch member 111 returned under the action of the spring to its engaged position with one of the depressions 109.

The radially movable device may take various forms, for example, instead of a grub-screw a knurled headed screw can be used. In another arrangement the screw can be replaced by a spring loaded plunger or pin.

Figure 16:
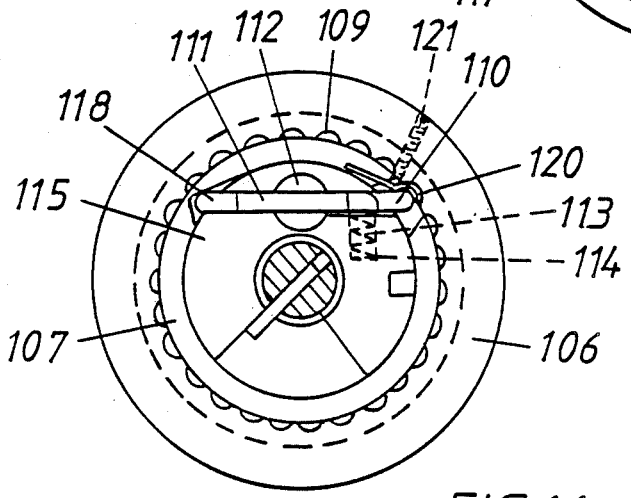
FIG. 16 is a cross-section of an alternative embodiment of the improved combination lock.

In order to prevent any inadvertent alteration in the combination code by moving the outer ring 106 relative to the inner ring 107, when the latch member is in the open position, the modified lock shown in FIG. 16 has a mechanical locking arrangement to prevent the friction provided by the leaf spring 101 being overidden.

In the embodiment of the improved combination lock shown in FIG. 16, the lock comprises an outer ring 106 and an inner ring 107, the two rings being held in engagement by a leaf spring 120 located in a slot in the inner ring 107. This spring has an outward pressure and is of sufficient depth in one of the depressions 109 to retain it and to lock the combination code.

When the door handle is turned to open the lock, the latch 111 moves into the depression 109, and the turning pressure on the door handle forces the nose portion 110 of the latch member upwards and further into the curved end of the leaf spring 120. The curve of the spring is sufficient to hold the spring and the latch member together. A grub screw 121 extends through the outer ring 106 to engage the latch member 111. If the grub screw 121 is screwed in the leaf spring 120 will move down with the nose portion 110 of the latch member freeing it from the depression 109 enabling the combination code to be changed.

The combination code is changed by turning the outer ring 106 pulling the nose portion 110 of the latch member out of the curved overlap of the spring that keeps the two together. This action releases the leaf spring 120 allowing to return to the position that locks the ring members 106 and 107 together.

Various other modifications to positively lock the combination code are possible within the scope of the appended claims.

I claim:

1. A combination lock comprising a shaft, a plurality of discs mounted coaxially on the shaft for individual rotation thereon, each disc having a first internal annular surface formed with a depression, the depression of at least one disc defining an abutment edge, a latch member mounted between the shaft and the annular surfaces and extending parallel to the shaft, biasing means urging the latch member into engagement with the first annular surfaces, the discs being rotatable on the shaft without turning the shaft, except when all the depressions are aligned with the latch member, so that with the latch member in its latched position extending into the depressions rotating in one direction of the disc or discs having an abutment surface causes the abutment surface or surfaces to engage the latch member and turn the shaft.

2. A combination lock as claimed in claim 1, wherein the latch member is substantially rigid and is mounted on the shaft for rotation about a second axis parallel to but spaced from the shaft axis, such that rotation of the latch member about the second axis in opposite directions moves the free end of the latch member radially inwardly and outwardly, said biasing means tending to move it radially outwardly.

3. A combination lock as claimed in claim 1, wherein at least one edge of each depression is of ramp form so that rotation of one or more of the discs in the other direction causes the latch member to ride up the sides of the depressions back to its unlatched position.

4. A combination lock as claimed in claim 1, wherein the indexing means is provided to provide some resistance to the turning of each disc, which resistance is less than the resistance of the shaft to turning out sufficient to hold each disc in position while the other discs are turned.

5. A combination lock as claimed in claim 4, wherein each disc has a second internal annular surface formed with teeth and/or depressions and the indexing means engage the second surfaces.

6. A combination lock as claimed in claim 5, wherein the indexing means are spring loaded pins mounted on the shaft.

7. A combination lock as claimed in claim 1, wherein a sleeve for each disc is provided, the sleeve having a lug which engages an axial slot formed in a tubular cylinder co-axial with the shaft.

8. A combination lock as claimed in claim 7, wherein an aperture is provided in the periphery of each sleeve to uncover a code carried by each disc.

9. A combination lock as claimed in claim 5, wherein each disc is provided with a rotatable ring portion, carrying the teeth and/or depressions of the indexing means, which ring has a leaf spring allowing the ring to be rotated against the friction of the spring.

10. A combination lock as claimed in claim 4, wherein the indexing means are spring loaded ball bearings.

11. A combination lock as claimed in claim 1 wherein each disc has a rotatable ring portion, with a leaf spring allowing the ring to be rotated against the friction of the spring, the latch member having a nose portion extending into and engaging a depression of a series of depressions formed in the rotational ring portion to prevent rotation of the ring portion when the lock is in the open position.

12. A combination lock as claimed in claim 11, wherein the nose portion of the latch member can be displaced from its depression by a radially movable device.

13. A combination lock as claimed in claim 12, wherein the radially movable devices is a grub-screw.

14. A combination lock as claimed in claim 12, wherein the radially movable device is a spring-loaded pin.

15. A combination lock as claimed in claim 12, wherein the radially movable device is a knurled-headed screw threaded in the flange of a door handle incorporating the combination lock.

16. A combination lock as claimed in claim 1, wherein each disc has a rotatable ring portion, with a leaf spring locked relative to an inner ring and having a curved portion located in a series of depressions of an outer indexing ring, the latch member having a nose portion extending into the curved portion of the leaf spring and urging it into one of the series of depressions to positively lock the inner ring relative to the outer ring when the lock is in the open position.

17. A door handle incorporating a combination lock as set forth in claim 1.

* * * * *